US007191913B2

(12) United States Patent
Byrne

(10) Patent No.: US 7,191,913 B2
(45) Date of Patent: Mar. 20, 2007

(54) HAND-HELD PAINT CONTAINER

(75) Inventor: James M. Byrne, Wooster, OH (US)

(73) Assignee: The Wooster Brush Company, Wooster, OH (US)

( * ) Notice: Subject to any disclaimer, the term of this patent is extended or adjusted under 35 U.S.C. 154(b) by 75 days.

(21) Appl. No.: 10/957,825

(22) Filed: Oct. 4, 2004

(65) Prior Publication Data

US 2006/0071010 A1 Apr. 6, 2006

(51) Int. Cl.
*B05C 21/00* (2006.01)
*B65D 25/00* (2006.01)

(52) U.S. Cl. ..... 220/570; 220/754; 220/752; 224/148.5

(58) Field of Classification Search ..... 220/570, 220/754, 752, 771; D32/53.1; 224/148.5
See application file for complete search history.

(56) References Cited

U.S. PATENT DOCUMENTS 3,014,621 A * 12/1961 Povitz ..... 222/183
3,292,815 A * 12/1966 French et al. ..... 220/736
3,536,285 A 10/1970 Vaughn
3,595,431 A 7/1971 Bird
3,707,242 A * 12/1972 Golden et al. ..... 220/570
3,729,158 A 4/1973 Nagy
4,061,242 A 12/1977 Donlon
4,101,046 A 7/1978 Puntillo
4,164,299 A 8/1979 Fuhr
4,860,891 A 8/1989 Biggio
4,895,269 A 1/1990 Cade
4,927,046 A 5/1990 Armstrong
5,033,704 A 7/1991 Kerr
5,308,181 A 5/1994 Hull et al.
5,322,183 A 6/1994 Strachan
5,511,279 A * 4/1996 Ippolito ..... 15/257.06
5,549,216 A 8/1996 Scholl
D389,626 S 1/1998 Lundy
5,746,346 A 5/1998 Crilly
5,810,196 A 9/1998 Lundy
RE35,933 E 10/1998 Scholl
5,971,201 A 10/1999 Daw
6,062,389 A 5/2000 Kent
6,065,633 A 5/2000 Abbey
6,138,963 A 10/2000 Malvasio
D458,723 S 6/2002 Malvasio
D460,845 S 7/2002 Bergman (Continued)

*Primary Examiner*—Anthony D. Stashick
*Assistant Examiner*—Eugene Lhymn
(74) *Attorney, Agent, or Firm*—McNees, Wallace & Nurick LLC

(57) ABSTRACT

A hand-held container for paint and painting implements. The body of the paint container includes an internal reservoir for holding paint and a magnet housed within the body for securing a paint brush or the like within the reservoir. An automatically adjusting, flexible handle that includes a living hinges provides a means for holding a person's hand against the exterior of the body. The paint container also includes a body that is dividable into multiple compartments. A textured surface covers a portion of exterior of the handle and the body and creates a non-slip surface useful for gripping the container. A portion of the container is shaped in a manner that allows the container to function as a pitcher for dispensing fluids such as paint. Stabilizing legs formed on or attached to the front portion of the container allow the container to be also be used as a paint tray.

10 Claims, 12 Drawing Sheets

U.S. PATENT DOCUMENTS

| | | | | |
|---|---|---|---|---|
| D477,702 | S | 7/2003 | Kohn | |
| D482,830 | S * | 11/2003 | Kohn | D32/53.1 |
| D483,917 | S * | 12/2003 | Frantz | D32/53.1 |
| 6,708,838 | B2 | 3/2004 | Bergman et al. | |
| 2002/0036206 | A1 * | 3/2002 | Bergman et al. | 220/754 |
| 2004/0118861 | A1 | 6/2004 | Bergman et al. | |
| 2004/0195248 | A1 | 10/2004 | Garcia | |
| 2004/0206761 | A1 | 10/2004 | Frantz | |
| 2004/0256335 | A1 * | 12/2004 | Sholem | 211/70.6 |

* cited by examiner

HAND-HELD PAINT CONTAINER

STATEMENT REGARDING FEDERALLY FUNDED RESEARCH

This invention was not made by an agency of the United States Government nor under contract with an agency of the United States Government.

TECHNICAL FIELD OF THE INVENTION

This invention relates in general to containers for holding heavy or viscous fluids, and more particularly to a hand-held container for holding a volume of paint as well as implements useful for the task of painting.

BACKGROUND OF THE INVENTION

Commercially available painting products for industrial and/or residential use are commonplace in modern society. A painting project using conventional products requires the simultaneous balancing and manipulating of paint buckets, paint trays, rollers, brushes, and clean-up rags. Failing to effectively manage the use of these multiple items may result in inefficiency, increased labor costs, or an inferior painting project.

Paint buckets or trays are known in the art and may be useful for some applications where larger volumes of paint are required. However, these items are not necessarily appropriate for use with smaller brushes or rollers (e.g., 4.5 inch rollers) and smaller volumes of paint. Furthermore, holding and balancing a large paint-filled tray or bucket can actually be quite difficult or even dangerous if the individual using the tray or bucket is on a ladder or other elevated or uneven surface.

While coffee cans, cut-off milk cartons, and other plastic containers may serve the purpose of holding lesser volumes of paint for smaller paint jobs, these containers are often unstable and difficult to grip and lack other desirable structural and functional features. Furthermore, such makeshift containers may prove to be only marginally useful for both holding multiple painting implements and removing paint from such implements. Thus, there is a need for a hand-held container that may be easily and safely gripped without the need for manually making adjustments, and that is capable of holding multiple painting implements as well as a useful volume of paint.

SUMMARY OF THE INVENTION

Deficiencies in the prior art are overcome by the present invention, the various embodiments of which provide a conveniently sized hand-held container for holding paint or stain as well as various painting accessories. This paint container includes an internal reservoir, which in some embodiments is divided into a first compartment for holding a small brush and a second compartment for holding a small roller. A textured surface covers a portion of the body and creates a non-slip, grippable surface on the exterior of the body. Two of the general embodiments include a handle that is attachable or affixed to the exterior of the container. This handle is typically covered with or manufactured from rubberized plastic, rigid elastomer, or similar materials. One of the embodiments includes a storage feature formed in the body of the container for holding a paint rag or similar item, and another of the embodiments includes a magnetic means for detachably holding a paint brush to the interior of the container.

In the exemplary embodiments, a portion of the paint reservoir further includes a textured surface formed on the interior of the container and this textured surface further includes a plurality of ridges useful for removing paint from a paint roller. Additionally, the uppermost edge of the front portion of the body of the container extends forward and away from the bottom edge of the body, thereby allowing the container to function as a pitcher for dispensing fluids such as paint. In one embodiment, front stabilizers are included for facilitating the use of the paint container in a manner similar to that of a traditional paint roller tray.

Further advantages of the present invention will become apparent to those of ordinary skill in the art upon reading and understanding the following detailed description of the preferred embodiments.

BRIEF DESCRIPTION OF THE DRAWINGS

The accompanying drawings, which are incorporated into and form a part of the specification, schematically illustrate one or more exemplary embodiments of the invention and, together with the general description given above and detailed description of the preferred embodiments given below, serve to explain the principles of the invention.

DETAILED DESCRIPTION OF THE INVENTION

Figure 1A:
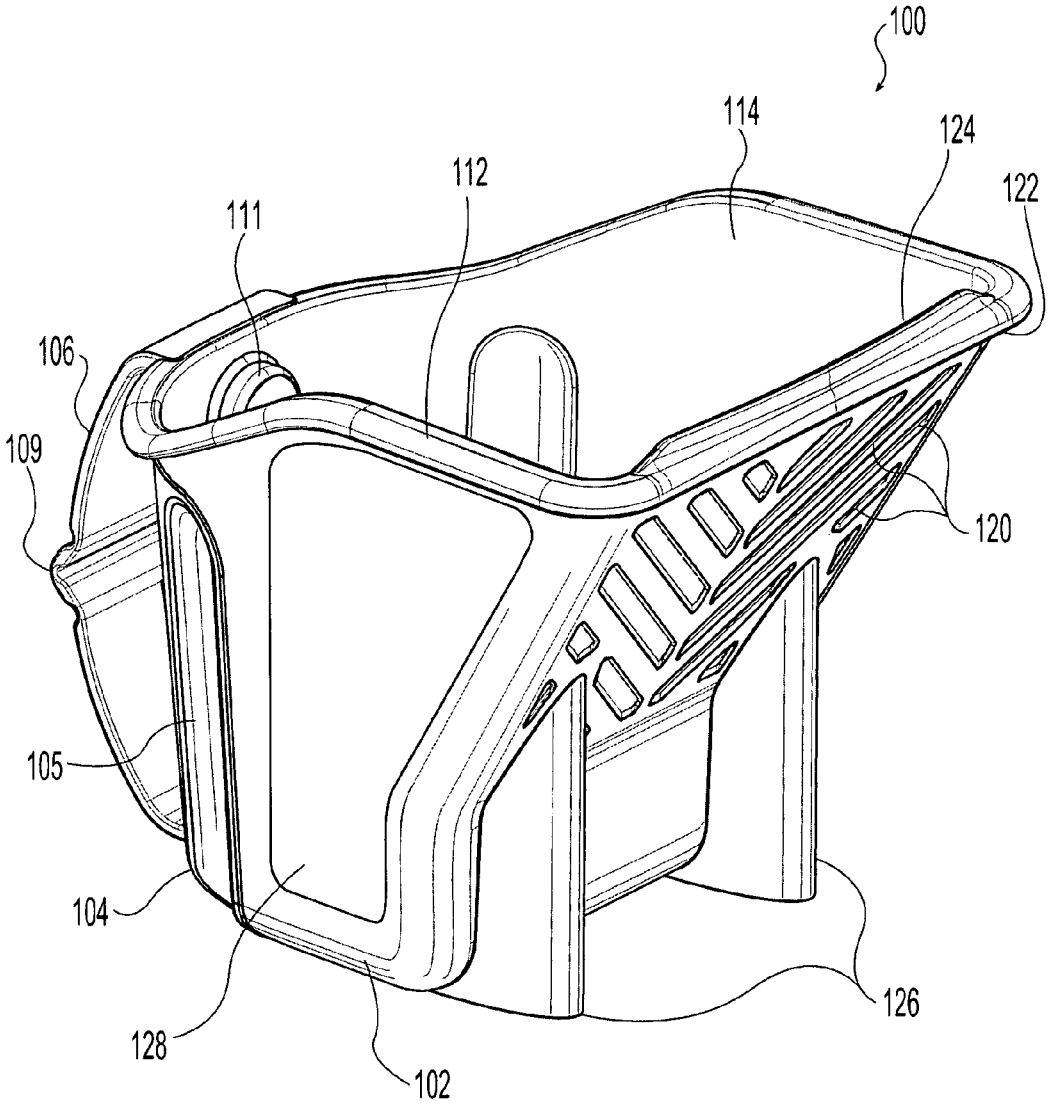
FIG. 1A is a front perspective view of a first exemplary embodiment of the hand-held paint container of the present invention showing the exterior features of the container.
Figure 1B:
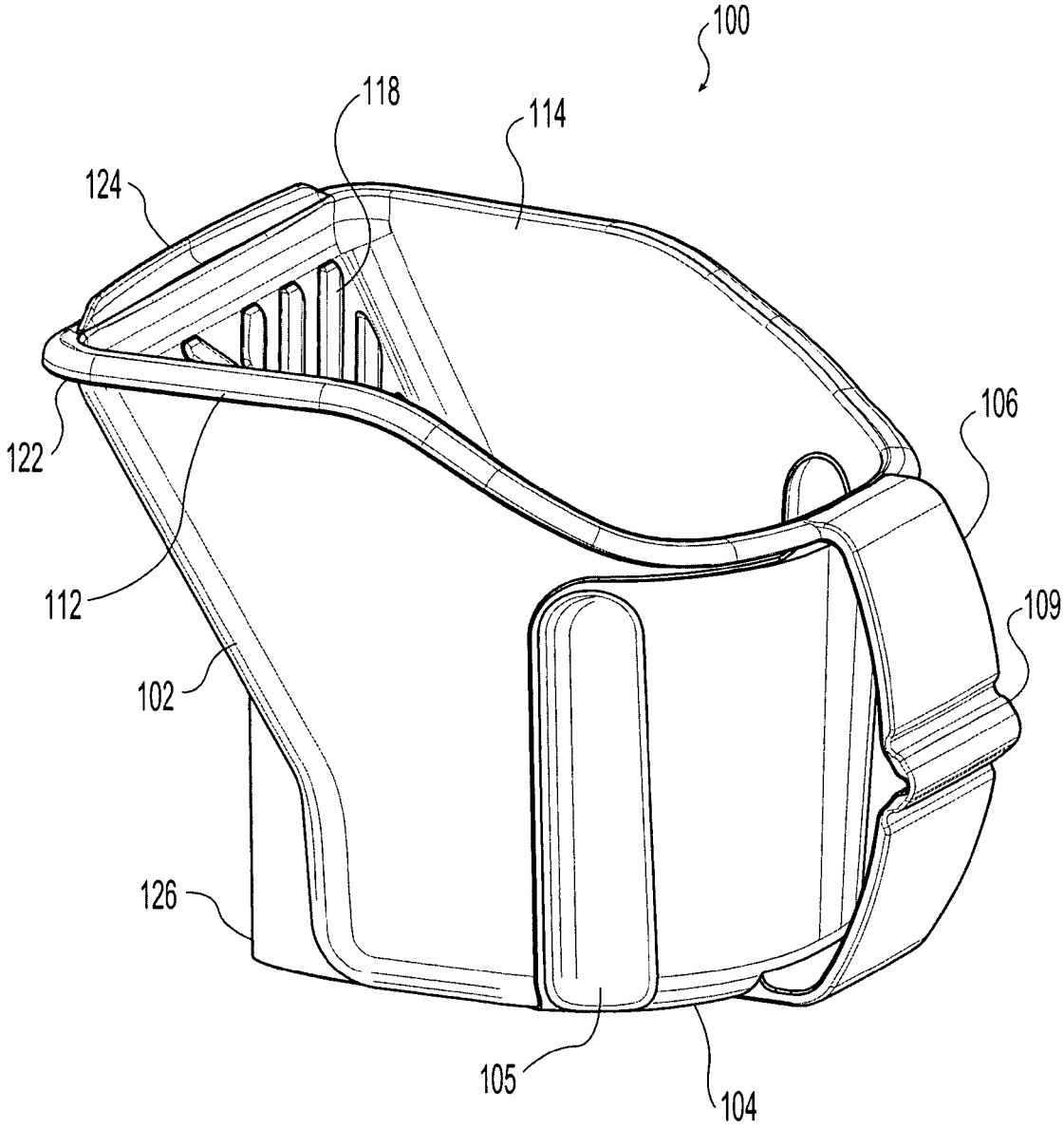
FIG. 1B is a rear perspective view of a first exemplary embodiment of the hand-held paint container of the present invention showing the exterior features of the container, particularly the hinged handle.
Figure 1C:
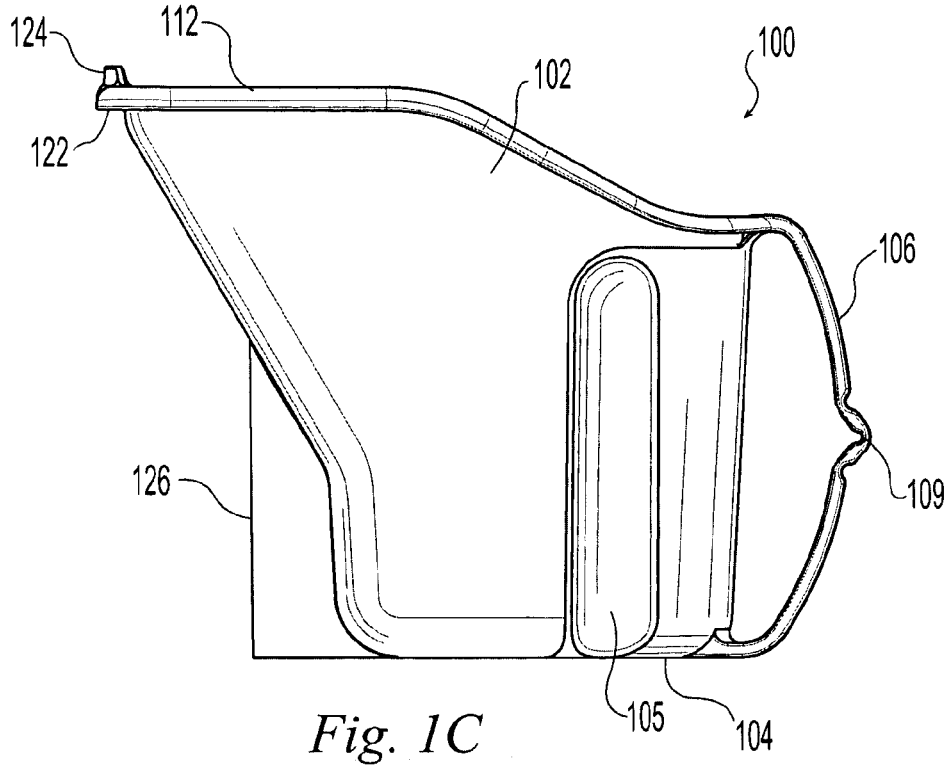
FIGS. 1C–D are left and right side views of the paint container of FIG. 1A.
Figure 1D:
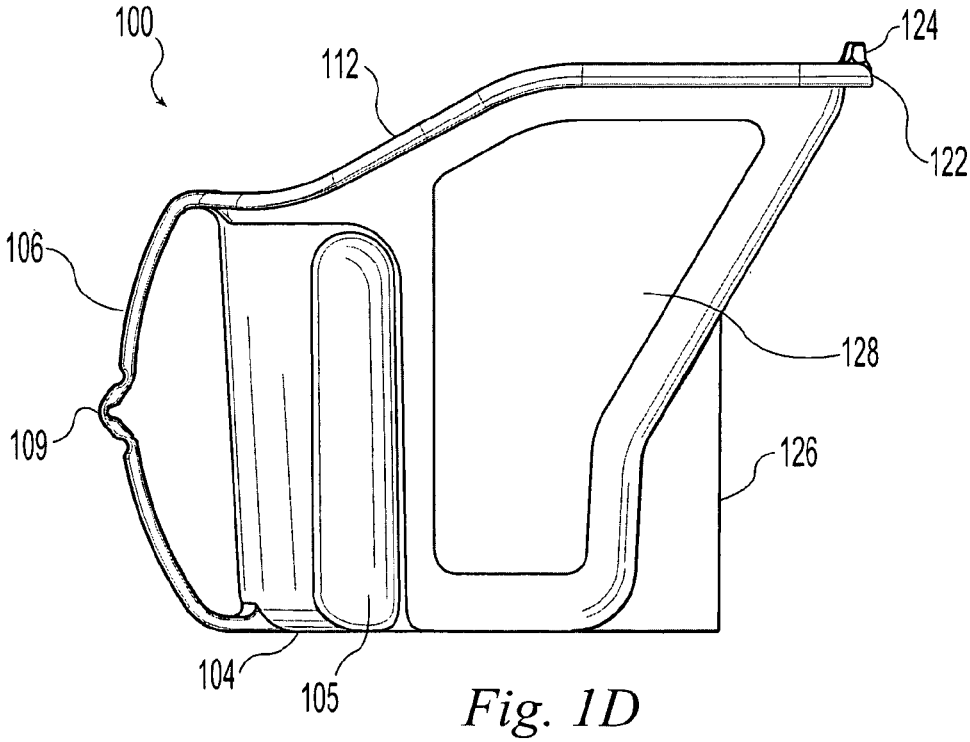
Figure 1E:
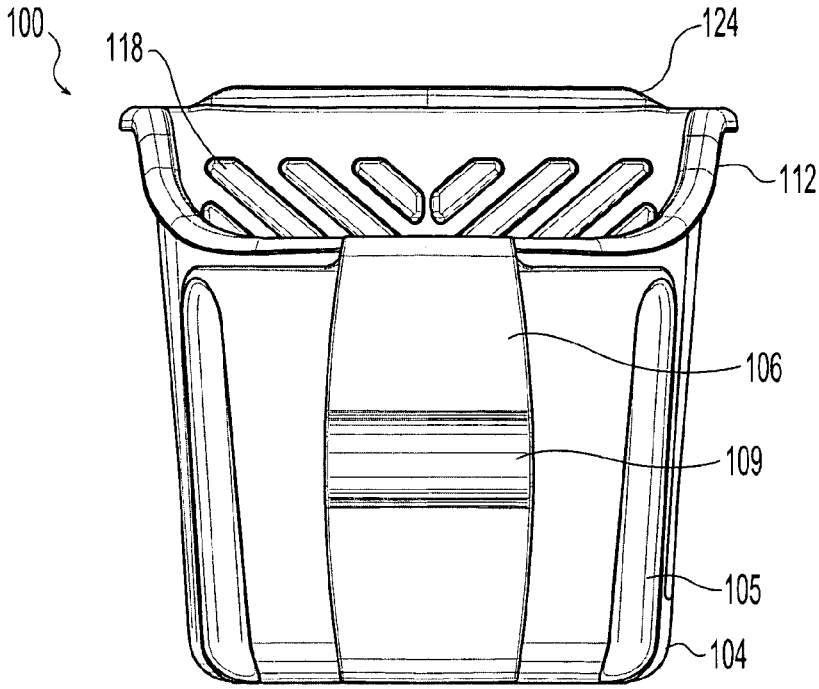
FIGS. 1E–F are front and back side views of the paint container of FIG. 1A.
Figure 1F:
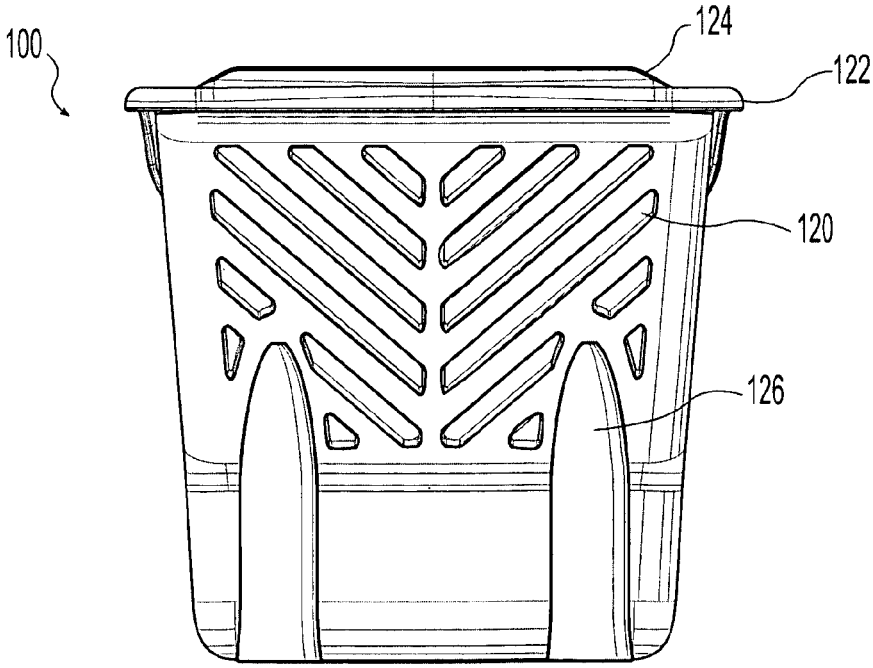

With reference now to the Figures, FIGS. 1A–G illustrate a first exemplary or general embodiment of the paint container of the present invention. As best shown in FIGS. 1A–B, hand-held paint container 100 for use with paint brushes and rollers includes a reservoir formed within the body of the container, as well as a first exterior surface 102 and a second exterior surface 104. In the exemplary embodiment, these surface textures are different from one another. Typically, second exterior surface 102 will include a grip-enhancing, elastomeric or rubberized material attached to or formed integrally with the exterior of paint container 100. The rear portion of the body of the paint container has been adapted to provide gripping means 105, the exterior portion of which includes the same texture as second exterior surface 104. As shown in the Figures, gripping means 105 includes substantially vertical indentations or grooves formed on both sides of the body of the paint container that accommodate the fingers and thumb of a person holding the paint container. In the embodiment shown in FIGS. 1A and 1D, container 100 further includes a third exterior surface 128 that may be used as a label area for a pressure sensitive label or for a label or text formed in and as part of the mold for the container.

As best shown in FIG. 1B, a handle 106 is attached to or, preferably, formed integrally with the rear portion of the body of paint container 100. While the body of the paint container is typically formed from plastic or other rigid material, handle 106 typically includes elastomer, rubber or other similar material that provides the handle with a degree of both flexibility and resiliency. In the exemplary embodiment shown in the Figures, handle 106 is fixedly attached to both the top and bottom edges of the rear portion of paint container 100 and provides a means for holding or securing the hand of the user against the body of the container when in use. A living hinge 109 is formed in handle 109 roughly midway along its length and provides a means by which the handle may automatically expand to accommodate different hand sizes. Thus, the geometry of living hinge 109 combined with the flexible properties of handle 106 provides the handle with "self-adjusting" capabilities.

As shown in FIG. 1A, paint container 100 also includes at least one magnetic means for holding or securing a paint brush within the reservoir. In the exemplary embodiment, a boss or housing 111 is formed in the rear portion of the body of container 100 for the purpose of housing a magnet. A magnet, preferably a high-power magnet, such as, for example, a neodymium magnet, is typically enclosed within housing 111 during the manufacturing process. This magnet provides sufficient magnetic force, through the material of the container, to detachably hold a magnetically responsive item, such as, for example, a three-inch paint brush, to the inner wall of the container. By completely enclosing the magnet within housing 111, the magnetic portion of container's interior surface can be easily cleaned and any performance diminishing build-up of paint or solvents around the magnet can be minimized.

Again with reference to FIGS. 1A–G, paint container 100 further includes a turned-down flange or lip 112 that surrounds the top edge of the container and reduces any unwanted loss of paint from the inside of the container when in use. Additionally, the front edge of the uppermost portion of the body of paint container 100 angles forward from and over the bottom edge of the front portion of the body to form a substantially planar, surface area (see FIGS. 1C and 1D). A portion of this surface area comprises textured surface 118 that further includes a plurality of ridges 120 formed in the material of container 100. Textured surface 118 provides an effective means for the user of the present invention to remove excess paint from a paint roller by simply directing a paint-filled roller over ridges 120. Front edge 122 extends forward from the basin portion of container 100 and allows the container to function as a pitcher-like device for pouring excess paint, water, or other fluid out of the container as desired. In the exemplary embodiment shown in FIGS. 1A–G, a raised area, ridge, or protrusion 124 is formed across the length of front edge 122 for the purpose of providing a brush scraping or drip catching device.

Figure 1G:
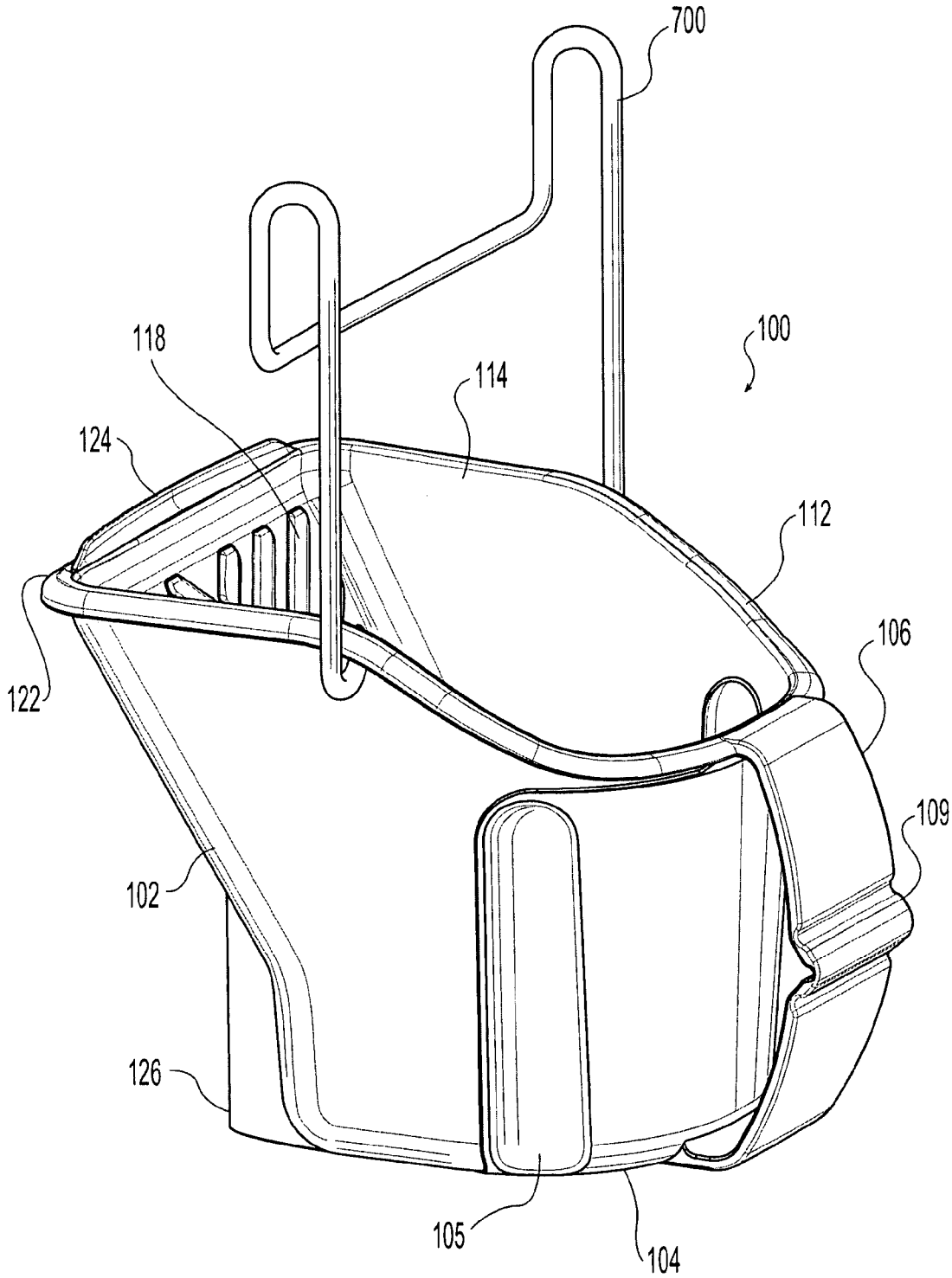
FIG. 1G is a front perspective view of a first exemplary embodiment of the hand-held paint container of the present invention showing the proper placement of the hanging device for use with a ladder.

As best shown in FIG. 1A, this exemplary embodiment of the paint container of the present invention also includes two stabilizers 126 formed on either side of the front portion of the container. These stabilizers 126 basically function as two legs or feet that allow container 100 to be placed on a level surface for use as a more traditional roller tray by reducing any tendency of the container to tip over in a forward direction when used in such manner. As shown in FIG. 1G, this embodiment is also compatible with a hanger 700 which provides a means for hanging container 100 from the rungs of a ladder when in use. Hanger 700 is attached to container 100 under flange or lip 112 and may then be hooked over the rungs of a ladder. The embodiment of the present invention shown in FIGS. 1A–G typically holds at least one quart of paint, but may be increased in size to hold greater volumes of paint, or decreased in size to hold lesser volumes of paint.

Figure 2A:
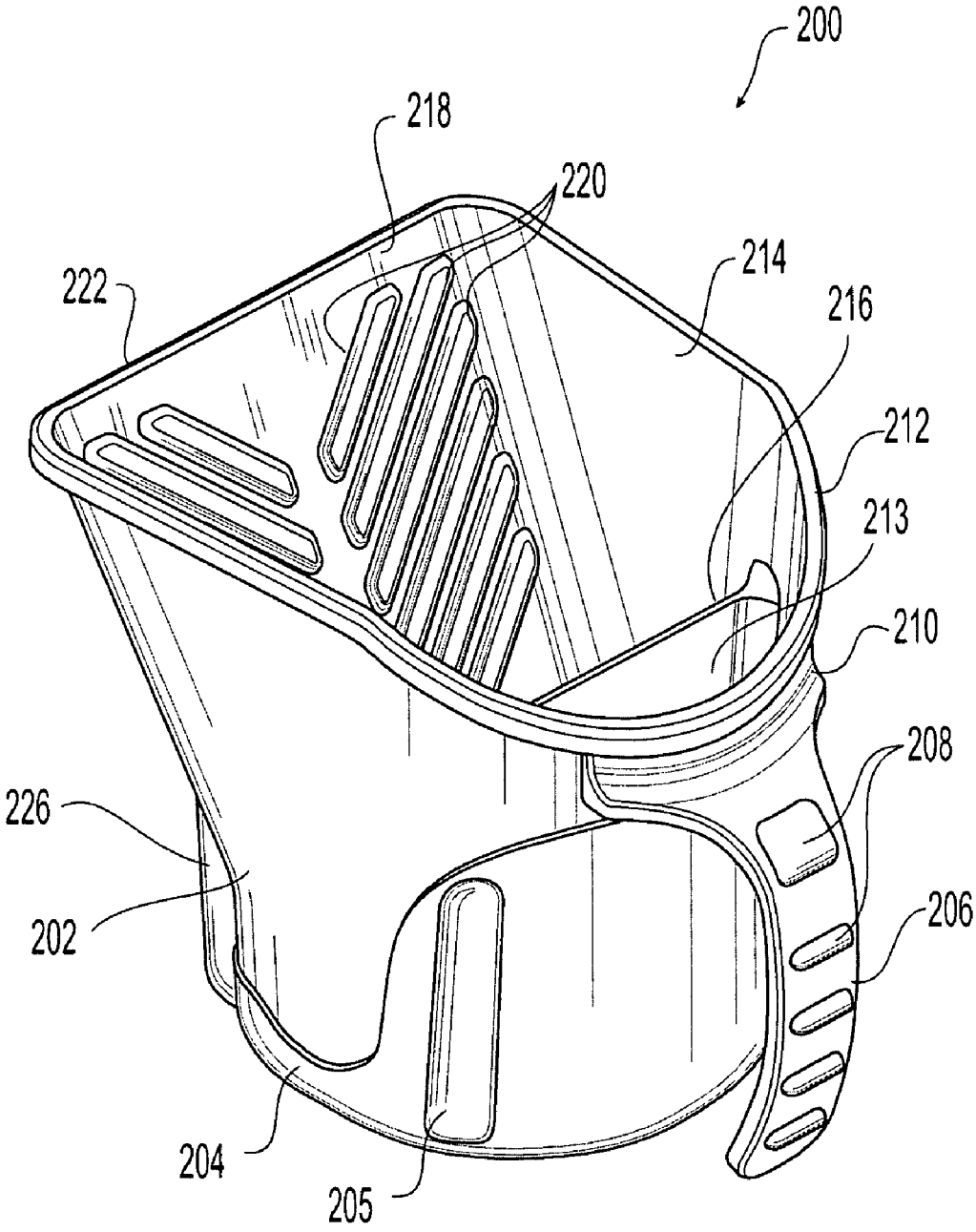
FIG. 2A is a rear perspective view of a second exemplary embodiment of the hand-held paint container of the present invention showing the attachable handle and the textured, multi-compartment interior.

FIGS. 2A–D show the second general embodiment of the hand-held paint container of the present invention. As best shown in FIG. 2A, hand-held paint container 200 includes a first exterior surface 202 and a second exterior surface 204 that is textured differently from the first exterior surface, and that may be coated with or manufactured from a rubberized or elastomeric material to create a substantially non-slip, graspable surface. In the exemplary embodiment shown in the Figures, second exterior surface 204 extends upward and over a substantial portion of the rear surface area of container 200 to provide the user with a means to better grasp the container if handle 206 is not used for that purpose. The rear portion of the body of the paint container has been adapted to provide gripping means 205, the exterior portion of which includes the same texture as second exterior surface 204. As shown in the Figures, gripping means 205 includes substantially vertical indentations or grooves formed on both sides of the body of the paint container that accommodate the fingers and thumb of a person holding the paint container.

Figure 2B:
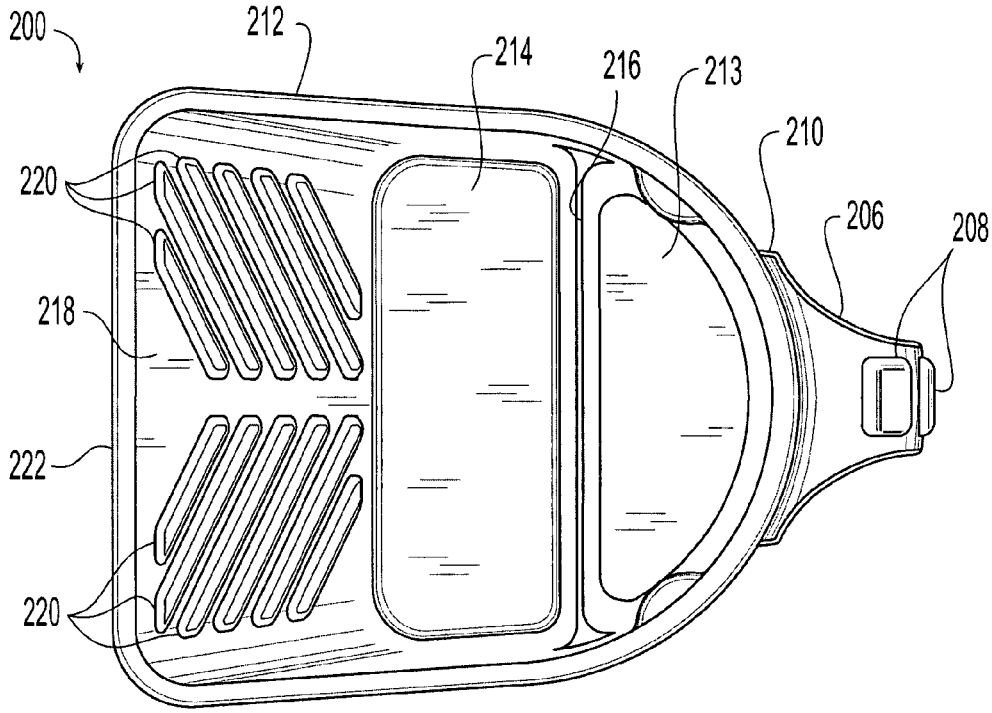
FIGS. 2B–C are top and side views of the hand-held paint container of FIG. 2A.
Figure 2C:
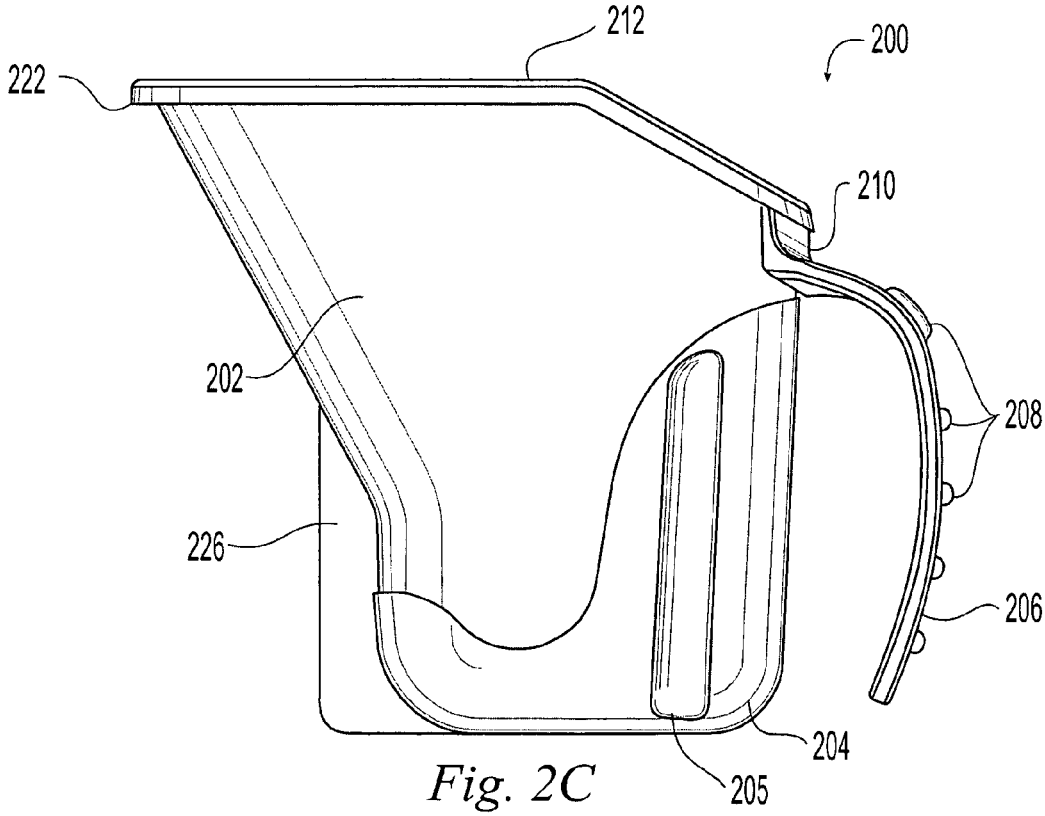
Figure 2D:
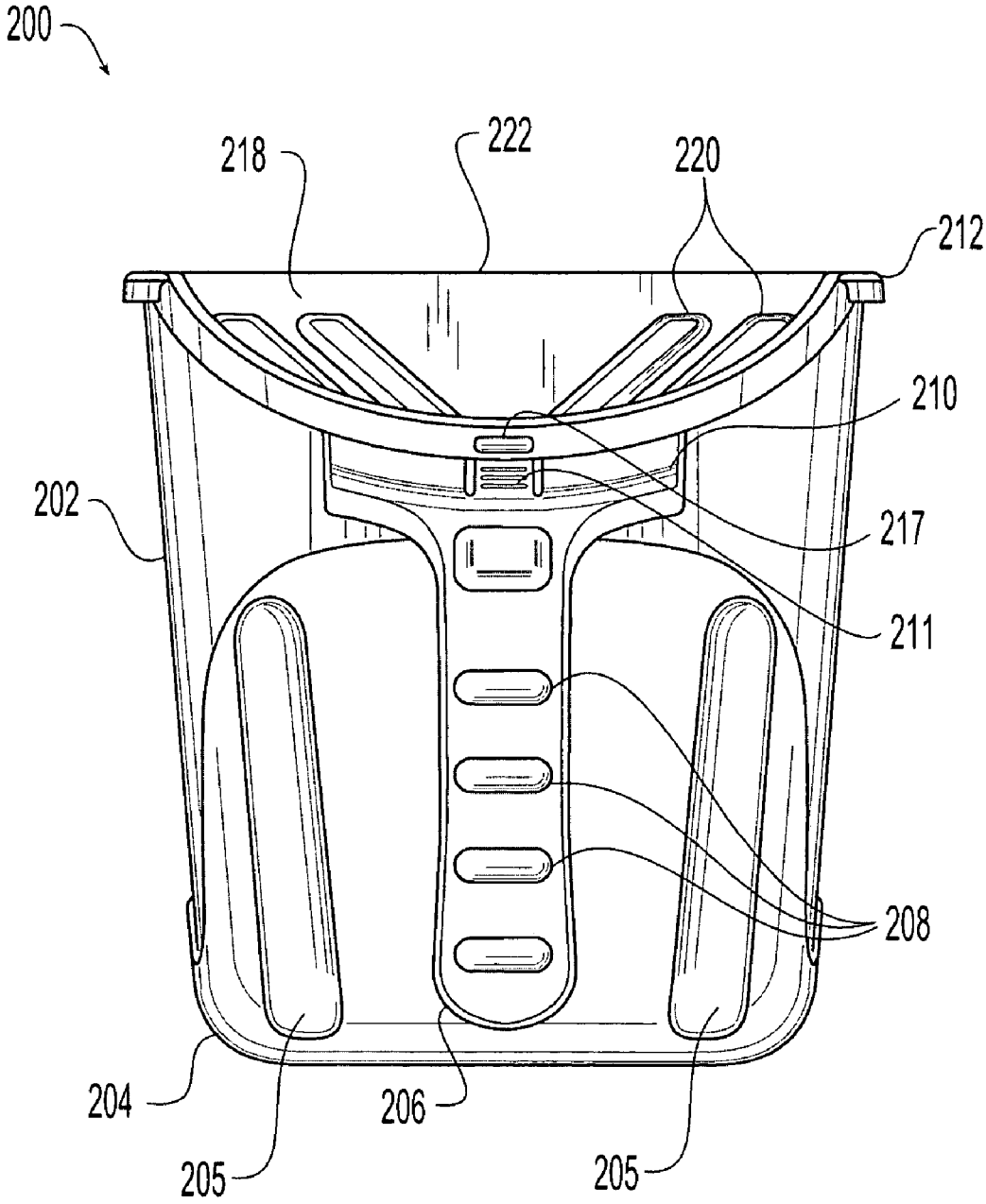
FIGS. 2D is a rear view of the hand-held paint container of FIG. 2A.

Handle 206 includes individual gripping surfaces 208 which may also be coated with or manufactured from an elastomeric or rubberized grip material (see also FIG. 2D). Handle 206 is attached to the body of container 200 by means of clip 210 which snaps into place underneath the portion of flange or lip 212 located on the rear portion of the container. As shown in FIG. 2D, clip 210 includes a flexible, ribbed, tongue-like structure 211 that engages an aperture 217 which is formed in the rearmost portion of lip 212 to hold handle 206 securely in place. In alternate embodiments, handle 206 is integral with (i.e., permanently affixed to) the body of container 200 and is not a separate piece detachably connected to the body of the container. In still another embodiment, handle 206 is fixedly attached to both the top and bottom edges of the rear portion of container 200.

In the second embodiment shown in the FIGS. 2A–D, the interior of hand-held paint container 200 is divided into a brush compartment 213 and a roller compartment 214 by a divider 216 that is formed in the interior portion of the container (see FIG. 2B). In other embodiments, a removal panel is utilized for the purpose of dividing the interior of the container. Brush compartment 213 is designed to hold a relatively small volume of paint and/or a small brush 600 while roller compartment 214 is designed to hold a somewhat larger volume of paint for use with a 4-inch (10.2 cm) roller 500 or a larger brush. Lip 212 surrounds the top edge of the container and reduces the unwanted loss of paint from the inside of the container when in use.

The front uppermost portion of the body of paint container 200 extends forward over the bottom portion of the body to form a substantially planar, downwardly angled, surface area (see FIG. 2C). A portion of this surface area comprises textured surface 218 that further includes a plurality of ridges 220 formed in the material of container 200. Textured surface 218 provides an effective means for the user of the present invention to remove excess paint from a roller prior to applying paint to a given surface by simply passing the paint-filled roller over ridges 220. As best shown in FIG. 2C, front edge 222 extends forward from the main basin portion of container 200, and basically allows the container to function as a pitcher-like device for pouring excess paint, water, or other fluid out of the container as desired. As also shown in FIG. 2C this exemplary embodiment includes two stabilizers 226 formed on either side of the front portion of the container. These stabilizers 226 basically function as two legs or feet that allow container 200 to be placed on a level surface for use as a more traditional roller tray by reducing any tendency of the container to tip over in a forward direction when used in such manner.

Figure 3A:
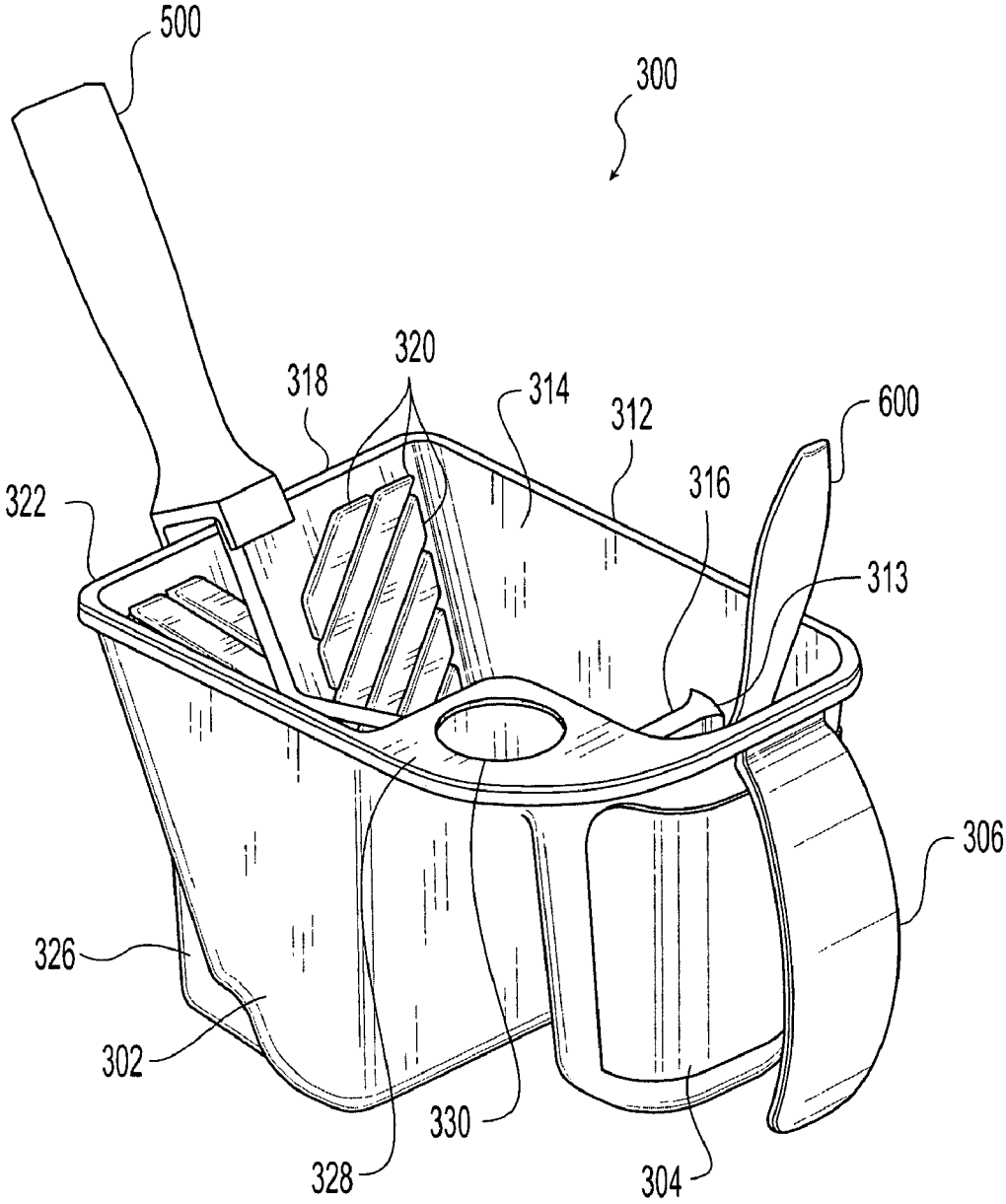
FIG. 3A is a rear perspective view of a third exemplary embodiment of the hand-held paint container of the present invention showing the rigid handle, the textured, multi-compartment interior, and the paint-rag holding/storage feature.
Figure 3B:
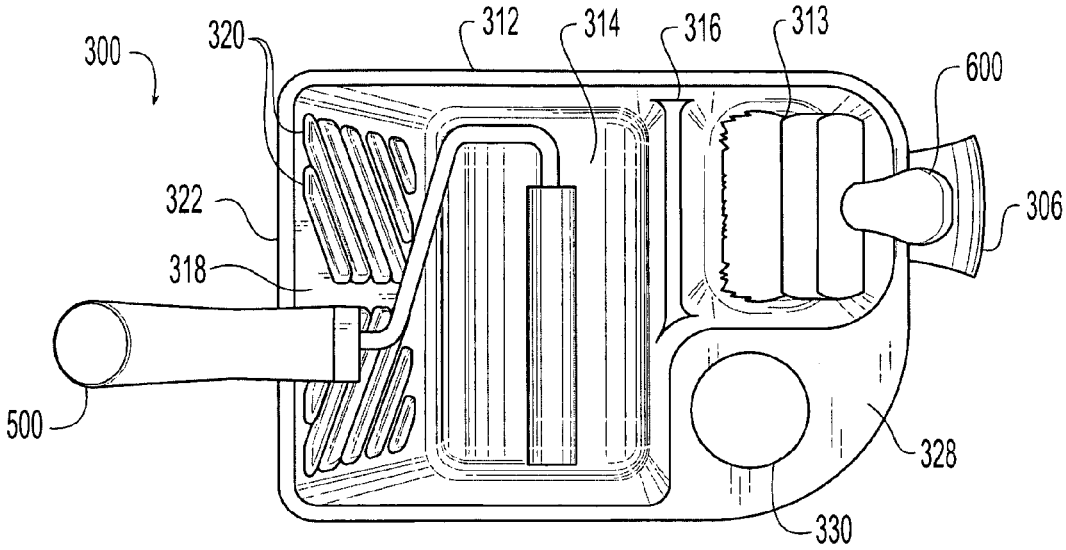
FIGS. 3B–C are top and side views respectively of the hand-held paint container of FIG. 3A showing the placement of the roller and brush within the multiple compartments of the container.
Figure 3C:
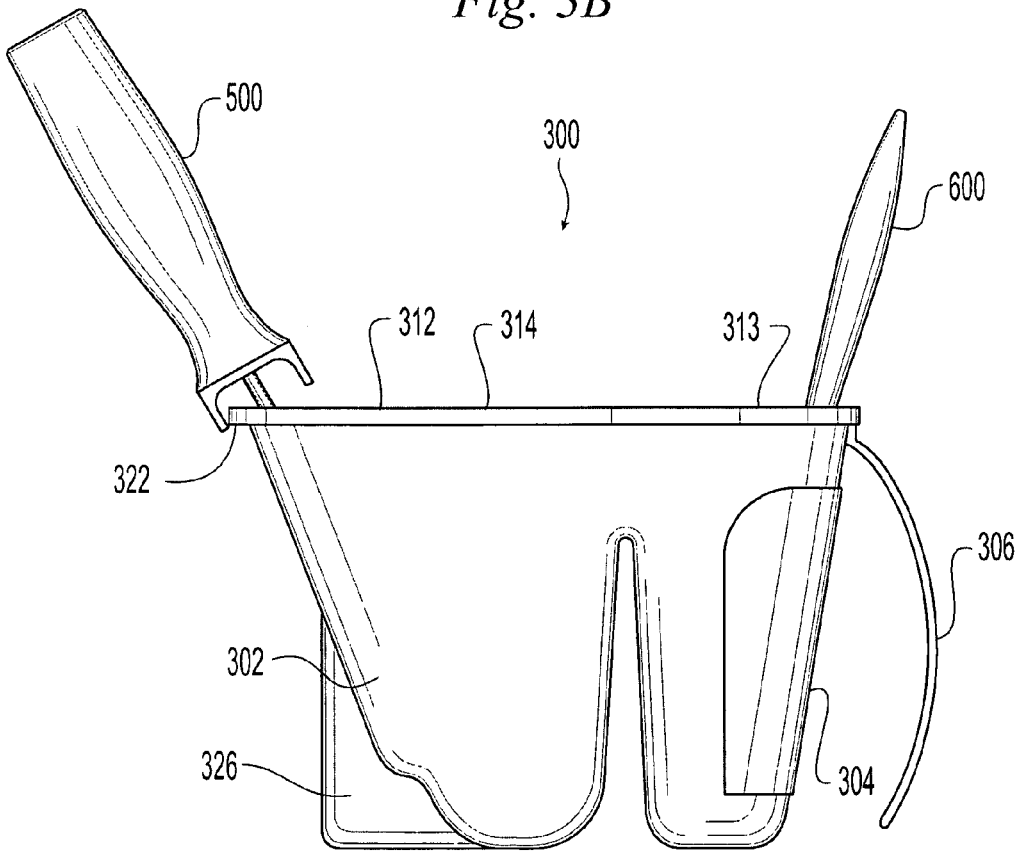

FIGS. 3A–C show a third general embodiment of the paint container of the present invention. In these Figures, paint container 300 includes a substantially smooth first exterior surface 302 and a second exterior surface 304 that is textured differently from the first exterior surface and that may be covered with or manufactured from a rubberized material to create a substantially non-slip, graspable surface. Second exterior surface 304 extends upward and over a portion of the rear surface area of container 300 to provide the user with a means to better grasp the container if handle 306 is not used for that purpose. Handle 306 is attached to the body of container 300 underneath the portion of lip 312 located on the rear portion of the container and may be covered with or manufactured from a rubberized or elastomeric material. In another embodiment, handle 306 is fixedly attached to both the top and bottom edges of the rear portion of container 300.

In the embodiment shown in FIGS. 3A–C, the body of hand-held paint container 300 is divided into a brush compartment 313 and a roller compartment 314 by a divider 316 that is formed in body of the container (see FIG. 3B). Brush compartment 313 is designed to hold a relatively small volume of paint and/or a small brush 600 while roller compartment 314 is designed to hold a somewhat larger volume of paint for use with a 4.5 inch (11.3 cm) roller 500 or a larger brush. As best shown in FIGS. 3A and 3B, the area of container 300 immediately adjacent to brush compartment 313 includes a storage feature 330 that may be used for holding a paint rag or another item. In the exemplary embodiment, storage feature 330 is simply an aperture passing through a shelf-like region 328 formed in the paint container's body. In another embodiment (not shown), this aperture is not completely closed in by shelf-like region 328, but rather is open on its outward facing side to facilitate the placement of a rag in the aperture.

As best shown in FIG. 3C, the front portion of the body of paint container 300 extends forward over the bottom portion of the body to form a substantially planar, downwardly angled, surface area. A portion of this surface area comprises textured surface 318 that further includes a plurality of ridges 320 formed in the material of container 300. Textured surface 318 provides an effective means for the user of the present invention to remove excess paint from a small roller prior to applying paint to a given surface by simply passing the paint-filled roller over ridges 320. As best shown in FIG. 3C, front edge 322 extends forward from the main basin portion of container 300, and basically allows the container to function as a pitcher-like device for pouring excess paint, water, or other fluid out of the container as desired. As also shown in FIG. 3C, this exemplary embodiment includes two stabilizers 326 formed on either side of the front portion of the container. These stabilizers 326 basically function as two legs or feet that allow container 300 to be placed on a level surface for use as a more traditional roller tray by reducing any tendency of the container to tip over in a forward direction when used in such manner.

Figure 4A:
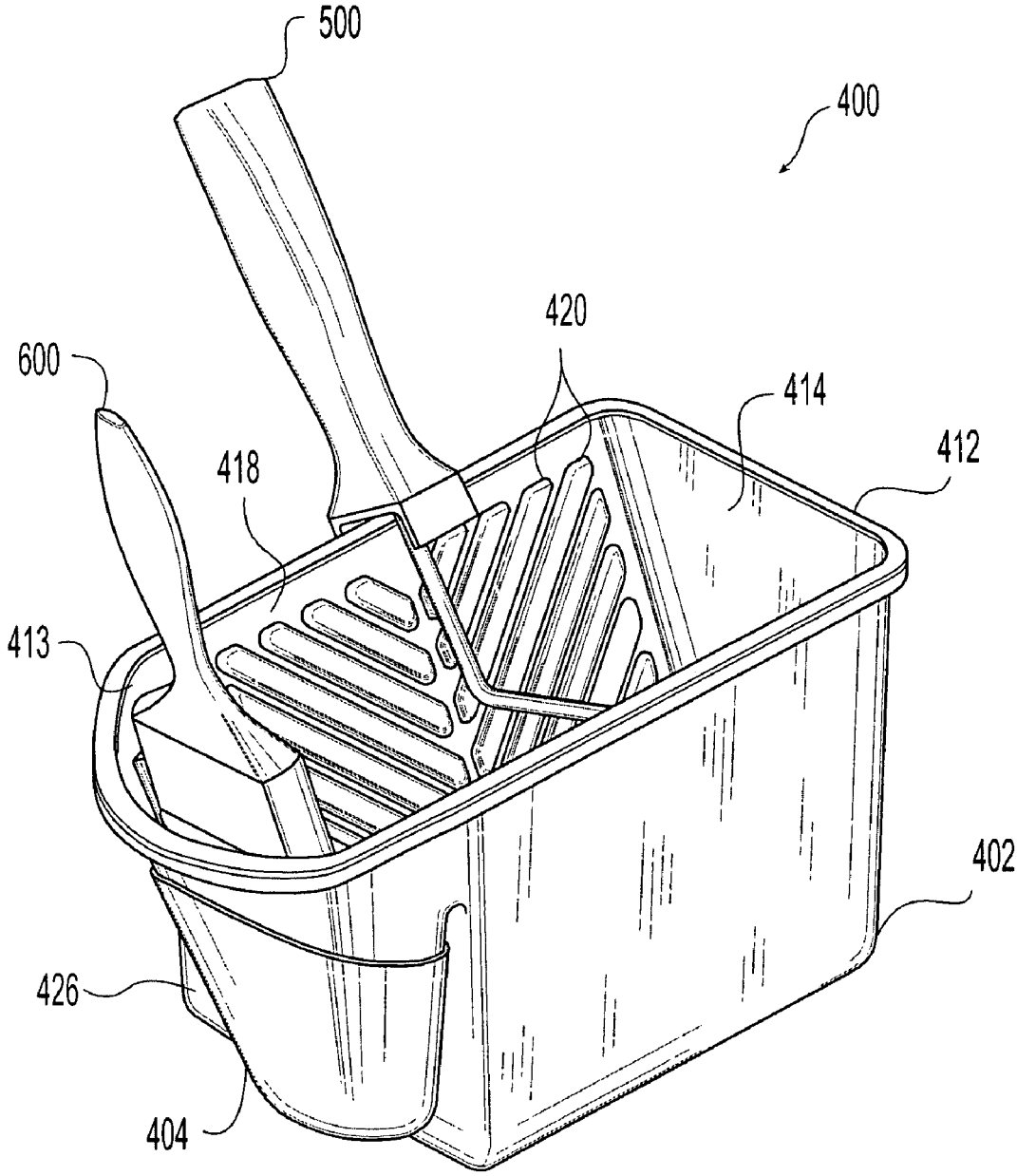
FIG. 4A is a front perspective view of a fourth exemplary embodiment of the hand-held paint container of the present invention showing the textured, multi-compartment interior and the painting implements placed therein.
Figure 4B:
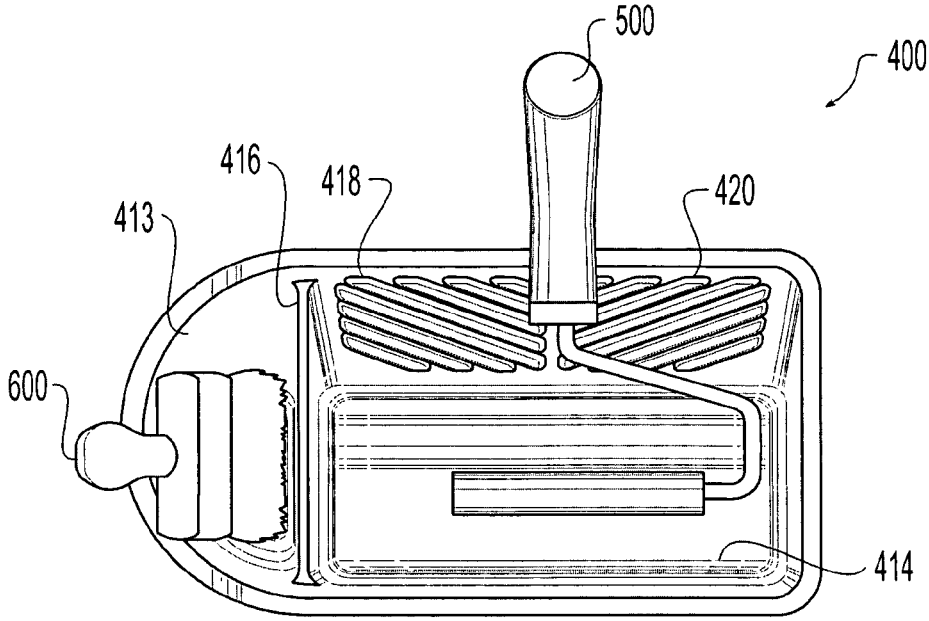
FIGS. 4B–C are top and side views of the hand-held paint container of FIG. 4A.
Figure 4C:
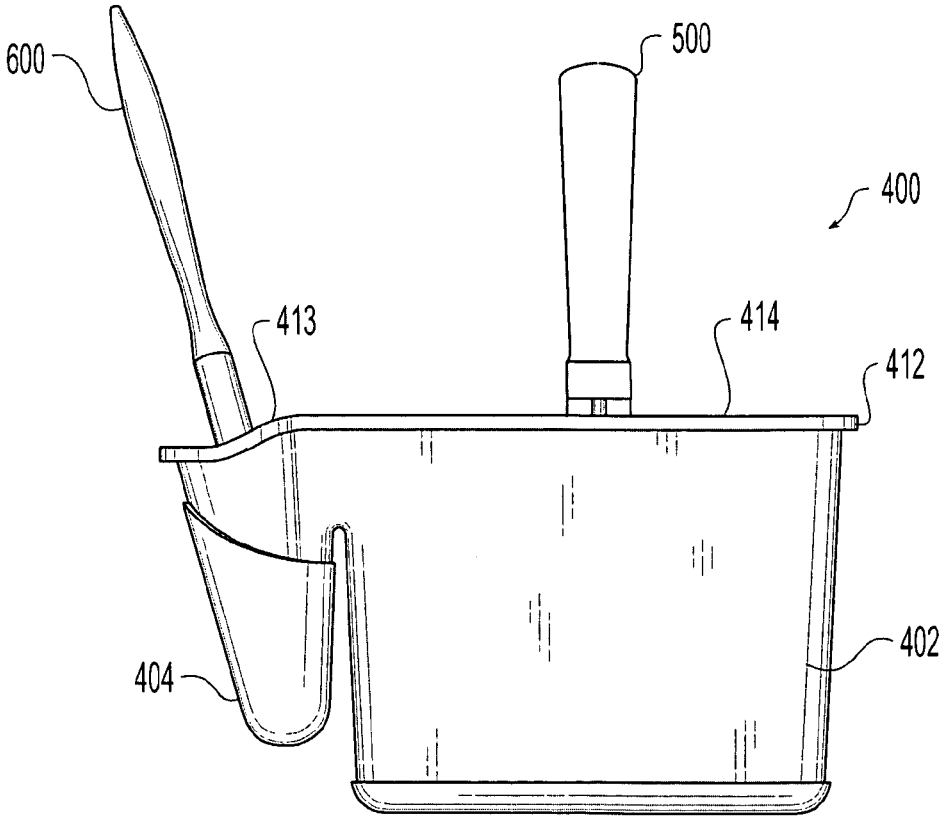

FIGS. 4A–C show a fourth general embodiment of the paint container of the present invention. In these Figures, paint container 400 includes a substantially smooth first exterior surface 402 and a second exterior surface 404 that is textured differently from the first exterior surface and that may be covered with or manufactured from a rubberized or elastomeric material to create a substantially non-slip, graspable surface. Second exterior surface 404 extends upward and over a portion of the exterior of brush compartment 413 to provide the user with a means to better grasp the container.

In the embodiment shown in the FIGS. 4A–C, the body of hand-held paint container 400 is divided into a brush compartment 413 and a roller compartment 414 by divider 416 that is formed in body of the container (see FIG. 4B). Lip 412 surrounds both compartments. Brush compartment 413 is designed to hold a relatively small volume of paint and/or a small brush 600 while roller compartment 414 is designed to hold a somewhat larger volume of paint for use with a 4-inch (10.2 cm) roller 500 or a larger brush.

As best shown in FIGS. 4A and 4B, one side of the body of paint container 400 extends slightly outward to form a substantially planar, downwardly angled, surface area. A portion of this surface area comprises textured surface 418 that further includes a plurality of ridges 420 formed in the material of container 400. Textured surface 418 provides an effective means for the user of the present invention to remove excess paint from a small roller prior to applying paint to a given surface by simply passing the paint-filled roller over ridges 420. As shown in FIG. 4A, this exemplary embodiment includes two stabilizers 426 formed on either side of the front portion of the container. These stabilizers 426 basically function as two legs or feet that allow container 400 to be placed on a level surface for use as a more traditional roller tray by reducing any tendency of the container to tip over in a forward direction when used in such manner.

In summary, all four general embodiments of the present invention provide the user with a sturdy, conveniently sized device for holding a volume of paint as well as one or more painting implements. Each embodiment of this invention may be manufactured using known methods and techniques and from a variety of materials, such as plastics, polymers, thermoplatic elastomers, or other suitably rigid and/or flexible materials all of which are known in the art of manufacturing. Of particular utility in manufacturing items that include multiple materials having different textures or physical characteristics, such as the present invention, is the insert molding and dual injection (i.e., "two shot") method of manufacturing. This method typically involves the use of multiple molds or tools and includes two basic steps. In general, for the present invention, the main body or reservoir of the paint container is manufactured first from a more rigid material such as plastic and the textured grip portion and handle are manufactured second using a thermoplastic elastomer, such as Santoprene TPE, which adheres to or bonds with the first portion of the body. In the embodiment of the present invention that includes the magnet, the magnet is placed within the main body of the container before the second molding step is executed. As will be appreciated by those skilled in the art, a number of known materials are compatible with the insert molding and dual injection method of manufacturing.

While the present invention has been illustrated by the description of exemplary embodiments thereof, and while the embodiments have been described in some detail, it is not the intention of the applicant to restrict or in any way limit the scope of the appended claims to such detail. Additional advantages and modifications will readily appear to those skilled in the art. Therefore, the invention in its broader aspects is not limited to any of the specific details, representative apparatus and methods, and illustrative examples shown and described. Accordingly, departures may be made from such details without departing from the spirit or scope of the applicant's general inventive concept.

What is claimed is:

1. A container for holding fluids, comprising:

(a) a body, wherein the body further comprises a reservoir formed therein, and wherein the top edge of the front portion of the body extends forward and angles away from the bottom edge of the front portion of the body to form a substantially planar surface area in the body;

(b) a flexible handle fixedly attached to the body, wherein the handle further comprises a living hinge formed substantially midway therein, and wherein the living hinge is substantially V-shaped and further includes: a first thinned area, a second thinned area, a third thinned area, a first hinge segment angularly disposed between the first and second thinned areas, a second hinge segment angularly disposed between the second and third thinned areas, wherein the second thinned area forms an arcuate region between the first and second hinge segments, and wherein the living hinge allows the flexible handle to self-adjust for accommodating different hand sizes; and (c) at least one magnet housed within the material of the body for securing a magnetically responsive item to the interior of the reservoir.

2. The container of claim 1, where in the container further comprises:

(a) a lip surrounding the upper perimeter of the body;

(b) a ridge formed atop the lip on the front portion the body;

(c) a plurality of ridges formed on the substantially planar surface on the interior of the body;

(d) at least one stabilizing leg formed on the front portion of the exterior of the body for preventing forward tipping; and (e) gripping means formed on the rear portion of the exterior of the body.

3. The container of claim 2, wherein the flexible handle and the gripping means further comprise at least one elastomeric material.

4. The container of claim 1, wherein the reservoir further comprises as least two separate compartments.

5. The container of claim 1, wherein the magnet further comprises a neodymium magnet.

6. A hand-held paint container, comprising:

(a) a body, wherein the top edge of the front portion of the body extends forward and angles away from the bottom edge of the front portion of the body to form a substantially planar surface area in the body, and wherein the body further comprises:

(i) a reservoir formed therein;

(ii) a lip surrounding the top edge thereof;

(iii) a ridge formed atop the lip on the front portion the body;

(iv) a plurality of ridges formed on the substantially planar surface on the interior of the body;

(v) at least one stabilizing leg formed on the front portion of the body for preventing forward tipping; and (vi) gripping means formed on the rear portion of the exterior of the body; and a flexible handle fixedly attached to the body, wherein the handle further comprises a multi-segmented living hinge formed substantially midway therein, and wherein the living hinge is substantially V-shaped and further includes: a first thinned area, a second thinned area, a third thinned area, a first hinge segment angularly disposed between the first and second thinned areas, a second hinge segment angularly disposed between the second and third thinned areas, wherein the second thinned areas forms an arcuate region between the first and second hinge segments, and wherein the living hinge allows the flexible handle to self-adjust for accommodating different hand sizes and (c) at least one magnet housed within the material of the body for securing a magnetically responsive item to the interior of the reservoir.

7. The container of claim 6, wherein the flexible handle and the gripping means further comprise at least one elastomeric material.

8. The container of claim 6, wherein the reservoir further comprises as least two separate compartments.

9. The container of claim 6, wherein the living hinge is formed midway along the length of the flexible handle.

10. The container of claim 6, wherein the magnet further comprises a neodymium magnet.

* * * * *